US009622637B1

(12) United States Patent
Hsieh et al.

(10) Patent No.: US 9,622,637 B1
(45) Date of Patent: Apr. 18, 2017

(54) COMBINED MOP

(71) Applicant: Protrend Co., Ltd., Taipei (TW)

(72) Inventors: Yu-Chuan Hsieh, Taipei (TW); Ji-Kan Wang, Taicang (CN)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 15/074,175

(22) Filed: Mar. 18, 2016

(51) Int. Cl.

| | |
|---|---|
| ***A47L 7/00*** | (2006.01) |
| ***A47L 13/22*** | (2006.01) |
| ***A47L 11/40*** | (2006.01) |
| *A47L 5/28* | (2006.01) |
| *A47L 9/32* | (2006.01) |
| *A47L 9/22* | (2006.01) |

(52) U.S. Cl.
CPC ..... *A47L 13/225* (2013.01); *A47L 11/4011* (2013.01); *A47L 11/4044* (2013.01); *A47L 5/28* (2013.01); *A47L 7/0004* (2013.01); *A47L 7/0009* (2013.01); *A47L 7/0019* (2013.01); *A47L 9/22* (2013.01); *A47L 9/325* (2013.01); *A47L 11/4086* (2013.01)

(58) Field of Classification Search
CPC ... A47L 5/28; A47L 9/22; A47L 9/325; A47L 7/0004; A47L 7/0009; A47L 7/0019; A47L 11/4011; A47L 11/4044; A47L 11/4086; A47L 13/225
IPC ..... A47L 7/00
See application file for complete search history.

(56) References Cited

U.S. PATENT DOCUMENTS

2014/0208536 A1* 7/2014 Ni ..... A47L 5/28 15/319
2014/0245561 A1* 9/2014 Pi ..... A47L 9/16 15/322

* cited by examiner

*Primary Examiner* — David Redding
(74) *Attorney, Agent, or Firm* — WPAT, PC; Justin King

(57) ABSTRACT

A combined mop is provided, which comprises a mop rack, a handle, a mop head, a dust collector, and a steam cleaner, wherein the dust collector and the steam cleaner are respectively connected with a power supply, and are detachably disposed on the mop rack. The mop rack is provided with a channel, and the channel is communicated with the mop head and the dust collector or a steam cleaner. The dust collector and the steam cleaner are detachably disposed on the mop rack. The dust collector or the steam cleaner can be cooperatively used together with the mop rack, the handle, and the mop head, thereby improving the cleaning efficiency. Moreover, the dust collector and the steam cleaner allow the user to conveniently disassemble them from each other to separately use them, which can increase the application range of the combined mop.

15 Claims, 3 Drawing Sheets

COMBINED MOP

BACKGROUND OF THE INVENTION

1. Field of the Invention

The present invention generally relates to a cleaning tool, in particular to a combined mop which integrates dust collector with steam cleaner.

2. Description of the Related Art

Currently, the household ground cleaning appliance usually combines the functions of a dust collector and a steam mop. The dust collector is used to clean large dust and waste scraps, and the steam mop is used to clean sticky floating dust or oil stains, where the steam mop can heat up the stains by high-temperature steam and then wipe off the stains by the fabric at the bottom of the mop. The advantage of the above combination is that the time for a user to replace cleaning tool can be saved, and the user can switch the cleaning tool if the current cleaning tool cannot clean the stains; when the area to be cleaned is larger, the user can save more time.

In general, this kind of device usually adopts dust collector—steam cleaner integration design; in other words, both the dust collector and the steam cleaner are integrated into the housing of the mop rack, and cannot be separated. Which makes the device too heavy and the device can only be used to clean the ground, but cannot be used to clean a table, wall or window, etc.; if the user want clean the table, wall or window, the user should use other devices or install the special-purpose accessories on the rear of the device to clean the above objects; after the user cleans the above objects, the user should uninstall the accessories to switch to the grounding cleaning mode, which will waste a lot of time.

SUMMARY OF THE INVENTION

Therefore, it is necessary to provide a combined mop able to easily combine dust collector and steam cleaner so as to increase its application range and cleaning efficiency.

To achieve the foregoing objective, an combine mop is provided, which may include a mop rack, handle, mop head, a dust collector and a steam cleaner; the dust collector and the steam cleaner may be respectively connected to a power supply, and may be detachably disposed on the mop rack; the mop rack may be provided with a channel, and the channel may connect the mop head to the dust collector or the steam cleaner.

In a preferred embodiment, the channel may include a dust collecting passage and a steam cleaning passage; the channel may extend toward the mop head and form a hole at one end of the mop head; the dust collecting passage may be connected to the dust collector, and the steam cleaning passage may be connected to the steam cleaner.

In a preferred embodiment, the dust collector and the steam cleaner may be respectively provided with a dust collector fixation hole and a steam cleaner fixation hole, which may be respectively corresponding to the steam cleaning passage and the dust collecting passage.

In a preferred embodiment, the dust collector may include a dust collector main body, and the power supply connected to the dust collector may a battery set for powering the dust collector main body; the dust collector main body may be provided with a dust collecting hole and the dust collecting hole may be connected to the channel.

In a preferred embodiment, the steam cleaner may include a steam cleaner main body; the steam cleaner main body may be provided with a steam outlet and the steam outlet may be connected to the channel.

In a preferred embodiment, the dust collector and the steam cleaner may be respectively provided with a dust collector handle and a steam cleaner handle.

In a preferred embodiment, the mop head may be flat, and the mop head may be provided with a rotation connector connected to the bottom of the mop rack.

In a preferred embodiment, the mop rack may be provided with an electrical port, and the electrical port may be electrically connected to the dust collector and the steam cleaner; the handle may be provided with a switch button for connecting the power supply with or disconnect the power supply from the dust collector and the steam cleaner.

In a preferred embodiment, the combined mob may further include a control panel and a controller; the control panel may be disposed at the handle, and the control panel may be provided with an input device; the control panel may be connected to the controller; the input device may control the suction force of the dust collector and the steam amount of the steam cleaner via the controller.

The dust collector and the steam cleaner may be detachably disposed on the mop rack. The dust collector or the steam cleaner can be cooperatively used together with the mop rack, the handle, and the mop head, thereby improving the cleaning efficiency. Moreover, the dust collector and the steam cleaner allow the user to conveniently disassemble them from each other to separately use them, which can increase the application range of the combined mop.

BRIEF DESCRIPTION OF THE DRAWINGS

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1:
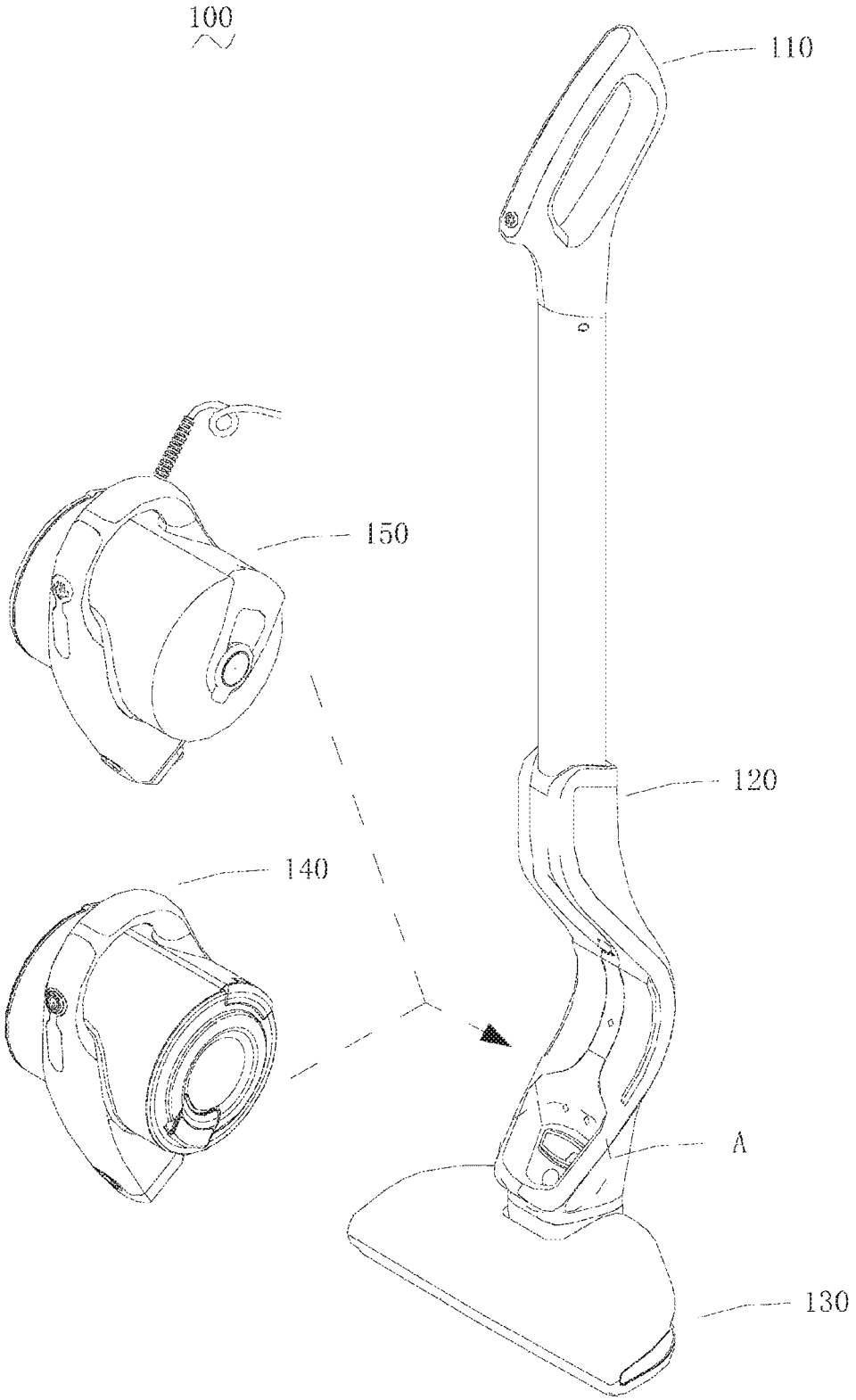
FIG. 1 is a 3D view of a combined mop in accordance with the present invention.

The technical content of the present invention will become apparent by the detailed description of the following embodiments and the illustration of related drawings as follows.

Please refer to FIG. 1~FIG. 4; the combined mop 100 may include a handle 110, a mop rack 120, a mop head 130, a dust collector 140 and a steam cleaner 150.

The handle 110 can be used for a user to hold and operate the combined mop 100. The handle 100 may be manufactured by plastic injection molding. In the embodiment, the handle 100 is formed by two half housings engaged with each other, which may also be manufactured by plastic injection molding. The handle 100 may be directly connected to the mop rack 120 or connected to the mop rack 120 via a connection bar.

The mop rack 120 may connect the handle 110 to the mop head 130. The dust collector 140 and the steam cleaner 150 may be detachably disposed on the mop rack 120. There are various methods for connecting the mop rack 120 to the dust collector 140 or the steam cleaner 150. For example, the mop rack 120 may be bent toward one side to accommodate the dust collector 140 or the steam cleaner 150, or the mop rack 120 may be provided with a fixation interface for fix the dust collector 140 or the steam cleaner 150. The mop rack 120 may include a channel, and the channel may connect the dust collector 140 or the steam cleaner 150 to the mop head 130.

Figure 2:
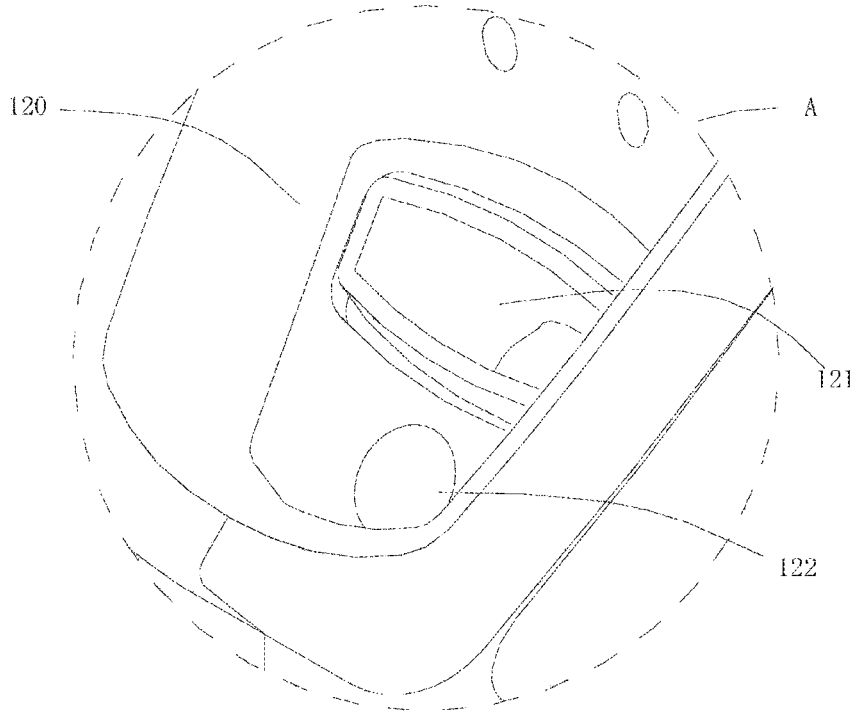
FIG. 2 is a partial enlargement of the A part of FIG. 1.

Please refer to FIG. 2, which shows a partial enlargement of the A part of FIG. 1; in the embodiment, the channel includes a dust collecting passage 121 and a steam cleaning passage 122. The dust collecting passage 112 may connect the dust collector 140 to the mop head 130; the steam cleaning passage 122 may connect the steam cleaner 150 to the mop head 130. Of course, the channel may only include one passage connected to both of the dust collector 140 and the steam cleaner 150.

Figure 3:
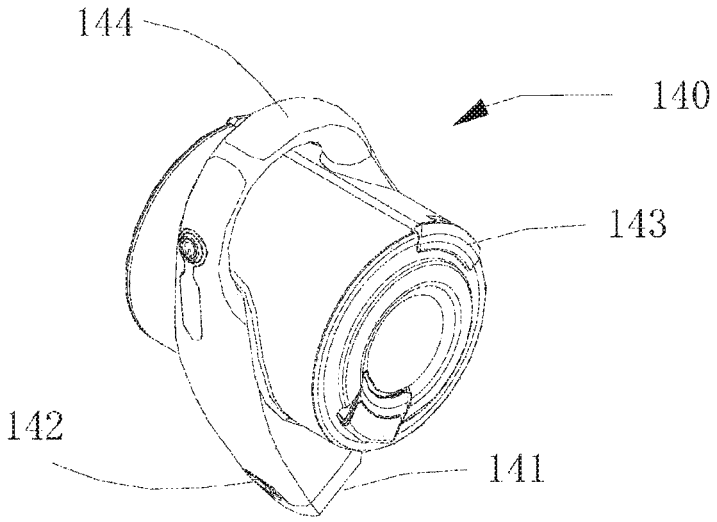
FIG. 3 is a schematic view of a dust collector in accordance with the present invention.

Please refer to FIG. 2 and FIG. 3; the dust collector 140 may include a dust collector main body 143 and a dust collecting hole 141; the dust collecting hole 141 may be connected to the dust collector main body 143 and the dust collecting passage 121; the shape of the dust collecting hole 141 may match the shape of the dust collecting passage 121. The dust collector 140 may be connected to a power supply; in the embodiment, the power supply is a battery set, and the battery set may be disposed inside the dust collector main body 143; the battery set may be used to power the dust collector 140. Of course, the dust collector 140 may also be connected to an AC power supply or an external battery, etc. The dust collector 140 may also be provided a dust collector fixation hole 142, and the shape of the dust collector fixation hole 142 may match the shape of the steam cleaning passage 122; the dust collector fixation hole 142 may be connected to the steam cleaning passage 122 via a snap-fit. When the dust collector 140 is installed on the mop rack 120, the steam cleaning passage 122 can stably fix the dust collector 140 on the mop rack 120.

Figure 4:
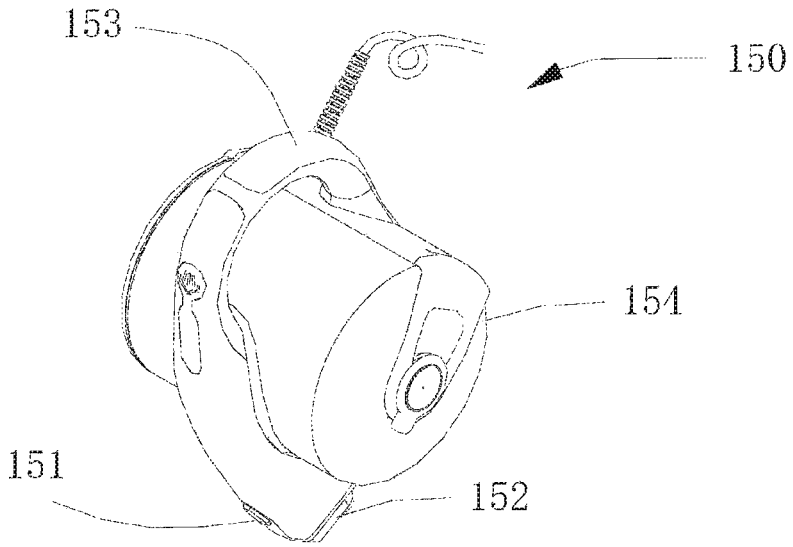
FIG. 4 is a schematic view of a steam cleaner in accordance with the present invention.

Please refer to FIG. 2 and FIG. 4; the steam cleaner 150 may include a steam cleaning main body 154; the steam cleaning main body 154 may be provided with a steam outlet 151. The steam outlet 151 may be connected to the steam cleaning passage 122, and the shape of the steam outlet 151 may match the shape of the steam cleaning path 122. The steam cleaner 150 may be connected to a power supply; in the embodiment, the steam cleaner 150 is connected to an AC power supply; of course, a battery set can also be used to power the steam cleaner 150. The steam cleaner 150 may further include a steam cleaner handle 153 for the user to hold and operate the steam cleaner 150. The steam cleaner 150 may also be provided with a steam cleaner fixation hole 152, and the shape of the steam cleaner fixation hole 152 may match the shape of the dust collecting passage 121; the shape of the steam cleaning fixation hole 152 may match the shape of the dust collecting passage 121, and the steam cleaning fixation hole 152 may be connected to the dust collecting passage 121 via a snap-fit. When the steam cleaner 150 is installed on the mop rack 120, the dust collecting passage 121 can stably fix the steam cleaner 150 on the mop rack 120.

The mop head 130 may be flat, and the mop head 130 may be provided with a rotation connector connected to the bottom of the mop rack 120; the rotation connector may be used to rotate the mop head 130. The steam cleaning passage 122 or the dust collecting passage 121 connected to the mop head 130 may form a corresponding hole at the bottom of the mop head 130, which can be used to collect dust or spray steam.

In the embodiment, only one of the dust collector 140 and the steam cleaner 150 is installed on the mop rack 120. The mop rack 120 may be provided with an electrical port, and the electrical port is electrically connected to the dust collector 140 or the steam cleaner 150; the handle 110 may be provided with a switch button for connecting the power supply with or disconnect the power supply from the dust collector 140 and the steam cleaner 150. When the user cannot use the combined mob 100 to clean the stains, the user can remove the dust collector 140 or the steam cleaner 150 from the combined mop 100, and the install a corresponding accessory to clean the stains. In this way, the application range of the combined mop 100 can be increased.

The combined mob 100 may further include a control panel and a controller; the control panel may be disposed at the handle 110, and the control panel may be provided with an input device; the control panel may be connected to the controller; the input device may control the suction force of the dust collector 140 or the steam amount of the steam cleaner 150 via the controller. The input device may also be a button, and the suction force of the dust collector 140 and the steam amount of the steam cleaner 150 may be increased or decreased by pressing the button. Moreover, the input device may also be a knob, and the suction force of the dust collector 140 and the steam amount of the steam cleaner 150 may be increased or decreased by clockwise or counter-clockwise rotating the knob.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A combined mop, comprising a mop rack, a handle, a mop head, a dust collector and a steam cleaner, wherein the dust collector and the steam cleaner are respectively connected to a power supply, and are detachably disposed on the mop rack; the mop rack is provided with a channel, and the channel connects the mop head to the dust collector or the steam cleaner.

2. The combined mop of claim 1, wherein the channel comprises a dust collecting passage and a steam cleaning passage; the channel extends toward the mop head and form a hole at one end of the mop head; the dust collecting passage is connected to the dust collector, and the steam cleaning passage is connected to the steam cleaner.

3. The combined mop of claim 2, wherein the dust collector and the steam cleaner are respectively provided with a dust collector fixation hole and a steam cleaner fixation hole respectively corresponding to the steam cleaning passage and the dust collecting passage.

4. The combined mop of claim 1, wherein the dust collector comprises a dust collector main body, and a power supply connected to the dust collector is a battery set for powering the dust collector main body; the dust collector main body is provided with a dust collecting hole and the dust collecting hole is connected to the channel.

5. The combined mop of claim 1, wherein the steam cleaner comprises a steam cleaner main body; the steam cleaner main body is provided with a steam outlet and the steam outlet is connected to the channel.

6. The combined mop of claim 1, wherein the dust collector and the steam cleaner are respectively provided with a dust collector handle and a steam cleaner handle.

7. The combined mop of claim 1, wherein the mop head is flat, and the mop head is provided with a rotation connector connected to a bottom of the mop rack.

8. The combined mop of claim 1, wherein the mop rack is provided with an electrical port, and the electrical port is electrically connected to the dust collector and the steam cleaner; the handle is provided with a switch button for connecting a power supply with or disconnect the power supply from the dust collector and the steam cleaner.

9. The combined mop of claim 2, wherein the mop rack is provided with an electrical port and the electrical port is electrically connected to the dust collector or the steam cleaner; the handle is provided with a switch button for connecting a power supply with or disconnect the power supply from the dust collector and the steam cleaner.

10. The combined mop of claim 3, wherein the mop rack is provided with an electrical port, and the electrical port is electrically connected to the dust collector and the steam cleaner; the handle is provided with a switch button for connecting a power supply with or disconnect the power supply from the dust collector and the steam cleaner.

11. The combined mop of claim 4, wherein the mop rack is provided with an electrical port, and the electrical port is electrically connected to the dust collector and the steam cleaner; the handle is provided with a switch button for connecting the power supply with or disconnect the power supply from the dust collector and the steam cleaner.

12. The combined mop of claim 5, wherein the mop rack is provided with an electrical port, and the electrical port is electrically connected to the dust collector and the steam cleaner; the handle is provided with a switch button for connecting a power supply with or disconnect the power supply from the dust collector and the steam cleaner.

13. The combined mop of claim 6, wherein the mop rack is provided with an electrical port, and the electrical port is electrically connected to the dust collector and the steam cleaner; the handle is provided with a switch button for connecting a power supply with or disconnect the power supply from the dust collector and the steam cleaner.

14. The combined mop of claim 7, wherein the mop rack is provided with an electrical port, and the electrical port is electrically connected to the dust collector and the steam cleaner; the handle is provided with a switch button for connecting a power supply with or disconnect the power supply from the dust collector and the steam cleaner.

15. The combined mop of claim 8, further comprising a control panel and a controller; the control panel is disposed at the handle, and the control panel is provided with an input device; the control panel is connected to the controller; the input device controls a suction force of the dust collector and a steam amount of the steam cleaner via the controller.

* * * * *